US012241236B2

(12) United States Patent
Tanaka et al.

(10) Patent No.: US 12,241,236 B2
(45) Date of Patent: Mar. 4, 2025

(54) WORK MACHINE INCLUDING A BOOM, AN ARM AND A BUCKET, AND FOR PERFORMING WORK INCLUDING FINISHING AND ROUGH EXCAVATION OF A FLAT SURFACE OR AN INCLINED SURFACE OF A CONSTRUCTION TARGET

(71) Applicant: HITACHI CONSTRUCTION MACHINERY CO., LTD., Tokyo (JP)

(72) Inventors: Hiroaki Tanaka, Ibaraki (JP); Hisami Nakano, Ibaraki (JP); Yusuke Suzuki, Ibaraki (JP); Hiroshi Sakamoto, Chiba (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 572 days.

(21) Appl. No.: 17/434,471

(22) PCT Filed: Sep. 28, 2020

(86) PCT No.: PCT/JP2020/036665
§ 371 (c)(1),
(2) Date: Aug. 27, 2021

(87) PCT Pub. No.: WO2021/065813
PCT Pub. Date: Apr. 8, 2021

(65) Prior Publication Data

US 2022/0136216 A1 May 5, 2022

(30) Foreign Application Priority Data

Sep. 30, 2019 (JP) ..... 2019-178442

(51) Int. Cl.
*E02F 3/43* (2006.01)
*E02F 9/22* (2006.01)
*E02F 9/26* (2006.01)

(52) U.S. Cl.
CPC ..... *E02F 9/265* (2013.01); *E02F 3/43* (2013.01); *E02F 9/22* (2013.01); *E02F 9/262* (2013.01)

(58) Field of Classification Search
CPC ..... E02F 9/265; E02F 3/43; E02F 9/22
See application file for complete search history.

(56) References Cited

U.S. PATENT DOCUMENTS 5,999,872 A * 12/1999 Kinugawa ..... E02F 9/2025 172/4
2016/0244950 A1* 8/2016 Kami ..... E02F 9/265
(Continued)

FOREIGN PATENT DOCUMENTS

EP 0 795 651 B1 5/2002
JP S6375224 A * 9/1986
(Continued)

OTHER PUBLICATIONS

Machine Translation of Foreign Reference JPS6375224A—Mori (Year: 1986).*
(Continued)

*Primary Examiner* — Jess Whittington
*Assistant Examiner* — Rami Nabih Bedewi
(74) *Attorney, Agent, or Firm* — MATTINGLY & MALUR, PC

(57) ABSTRACT

The present disclosure provides a work machine capable of providing operation assistance matching an operator's intent in consideration of a rotating motion. A control device includes a storage device and a central processing device. The storage device has stored therein construction target information for a work device and determination criteria information for the work content of the work device based on the amount of operation of a rotating device. The central processing device, based on the position and attitude of the
(Continued)

work device detected by a sensor, the amount of operation of the rotating device detected by an operation amount detection device, and the determination criteria information stored in the storage device, determines the work content of the work device, calculates a correction value for the construction target information based on the determined work content, and controls a drive device based on the construction target information and the correction value.

6 Claims, 10 Drawing Sheets

(56) References Cited

U.S. PATENT DOCUMENTS

| | | | | |
|---|---|---|---|---|
| 2017/0284070 | A1* | 10/2017 | Matsuyama | E02F 9/20 |
| 2018/0002899 | A1* | 1/2018 | Morimoto | E02F 3/43 |
| 2019/0218749 | A1* | 7/2019 | Hiromatsu | E02F 3/841 |
| 2020/0217050 | A1 | 7/2020 | Chiba et al. | |
| 2020/0224383 | A1 | 7/2020 | Ishida et al. | |
| 2020/0232179 | A1 | 7/2020 | Sasaki et al. | |
| 2020/0277752 | A1 | 9/2020 | Igarashi et al. | |
| 2021/0292999 | A1* | 9/2021 | Hamada | G07C 5/0841 |

FOREIGN PATENT DOCUMENTS

| | | | |
|---|---|---|---|
| JP | 2000-291076 | A | 10/2000 |
| JP | 2004-068433 | A | 3/2004 |
| JP | 2018-155077 | A | 10/2018 |
| JP | 2019-151973 | | 9/2019 |
| WO | 2016/129708 | A1 | 8/2016 |
| WO | 2019/049248 | A1 | 3/2019 |
| WO | 2019/124520 | A1 | 6/2019 |

OTHER PUBLICATIONS

Extended European Search Report received in corresponding European Application No. 20872854.3 dated Sep. 29, 2023.
International Search Report of PCT/JP2020/036665 dated Dec. 15, 2020.
Korean Office Action received in corresponding Korean Application No. 10-2021-7027971 dated Mar. 9, 2023.

* cited by examiner

WORK MACHINE INCLUDING A BOOM, AN ARM AND A BUCKET, AND FOR PERFORMING WORK INCLUDING FINISHING AND ROUGH EXCAVATION OF A FLAT SURFACE OR AN INCLINED SURFACE OF A CONSTRUCTION TARGET

TECHNICAL FIELD

The present disclosure relates to a work machine.

BACKGROUND ART

Conventionally, an invention relating to a control device for a work machine is known (see Patent Literature 1). The conventional control device for a work machine is a device for controlling a working unit with which the work machine is provided to perform construction on an object for construction. The control device includes a control unit for controlling the working unit so that a work implement of the work unit does not enter the shape of a predetermined target shape, and a switching unit which, based on the attitude of the work implement with respect to a target construction topography, which is the target finished shape of the object for construction, switches the target shape to an offset topography located away from the target construction topography by a predetermined distance, or to the target construction topography (see the Abstract of the literature, for example).

In the work machine control device, the switching unit, based on the magnitude of the angle formed by the target construction topography and the bottom surface of the bucket of the hydraulic shovel, switches the target shape during intervention control to the offset topography or to the target construction topography (see paragraph 0075 of the literature, for example). If the absolute value of the angle is greater than the absolute value of a predetermined threshold value, the switching unit switches the target shape during intervention control to the offset topography. If the absolute value of the angle is less than or equal to the absolute value of the predetermined threshold value, the switching unit switches the target shape during intervention control to the target construction topography (see paragraph 0076 of the literature, for example).

By such processing, the target shape during intervention control is switched automatically between the time of excavating topsoil and the time of finishing. As a result, during slope formation, the operator does not need to reset the offset amount when excavating topsoil and when finishing the object for construction. Thus, when forming a slope, the operator's work can be prevented from becoming too complicated (see paragraph 0077 of the literature, for example).

CITATION LIST

Patent Literature

Patent Literature 1: WO 2016/129708 A1

SUMMARY OF INVENTION

Technical Problem

Construction performed by a work machine may involve a rotating motion. However, in the conventional work machine control device, construction involving a rotating motion is not taken into consideration. Accordingly, during construction involving a rotating motion, the offset topography and the target construction topography may be switched against the operator's intent.

The present disclosure provides a work machine capable of providing operation assistance matching the operator's intent in consideration of a rotating motion.

Solution to Problem

According to an aspect of the present disclosure, there is provided a work machine including: a work device for performing work; a rotating structure having the work device mounted thereto; a rotating device for rotating the rotating structure; a travelling device for supporting and travelling the rotating structure via the rotating device; a drive device for driving the work device, the rotating device, and the travelling device; a position/attitude detection device for detecting a position and an attitude of the work device; an operating device for directing an operation of the work device, the rotating device, and the travelling device; an operation amount detection device for detecting an amount of operation of the operating device; and a control device for controlling the drive device based on the amount of operation and the position and the attitude of the work device. The control device includes a storage device and a central processing device. The storage device has stored therein construction target information for the work device, and determination criteria information for work content of the work device based on the amount of operation of the rotating device. The central processing device determines the work content of the work device based on the position and the attitude of the work device detected by the position/attitude detection device, the amount of operation of the rotating device detected by the operation amount detection device, and the determination criteria information, calculates a correction value for the construction target information based on the determined work content, and controls the drive device based on the construction target information and the correction value to assist an operation by an operator.

Advantageous Effects of Invention

According to the above aspect of the present disclosure, it is possible to provide a work machine capable of providing operation assistance matching the operator's intent in consideration of a rotating motion.

DESCRIPTION OF EMBODIMENTS

In the following, embodiments of the work machine of the present disclosure will be described with reference to the drawings.

Embodiment 1

Figure 1:
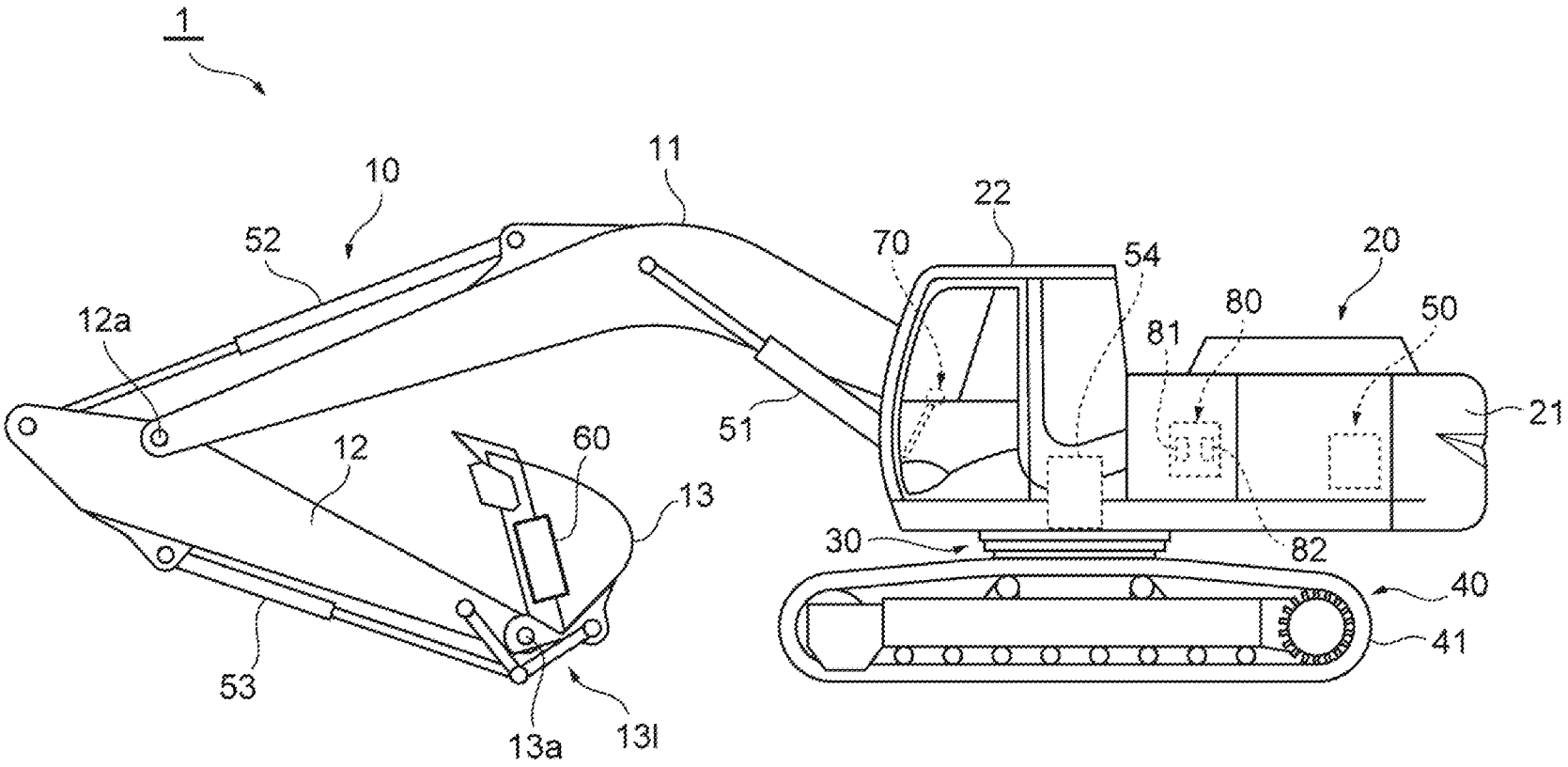
FIG. 1 is a schematic diagram illustrating Embodiment 1 of a work machine of the present disclosure.
Figure 2:
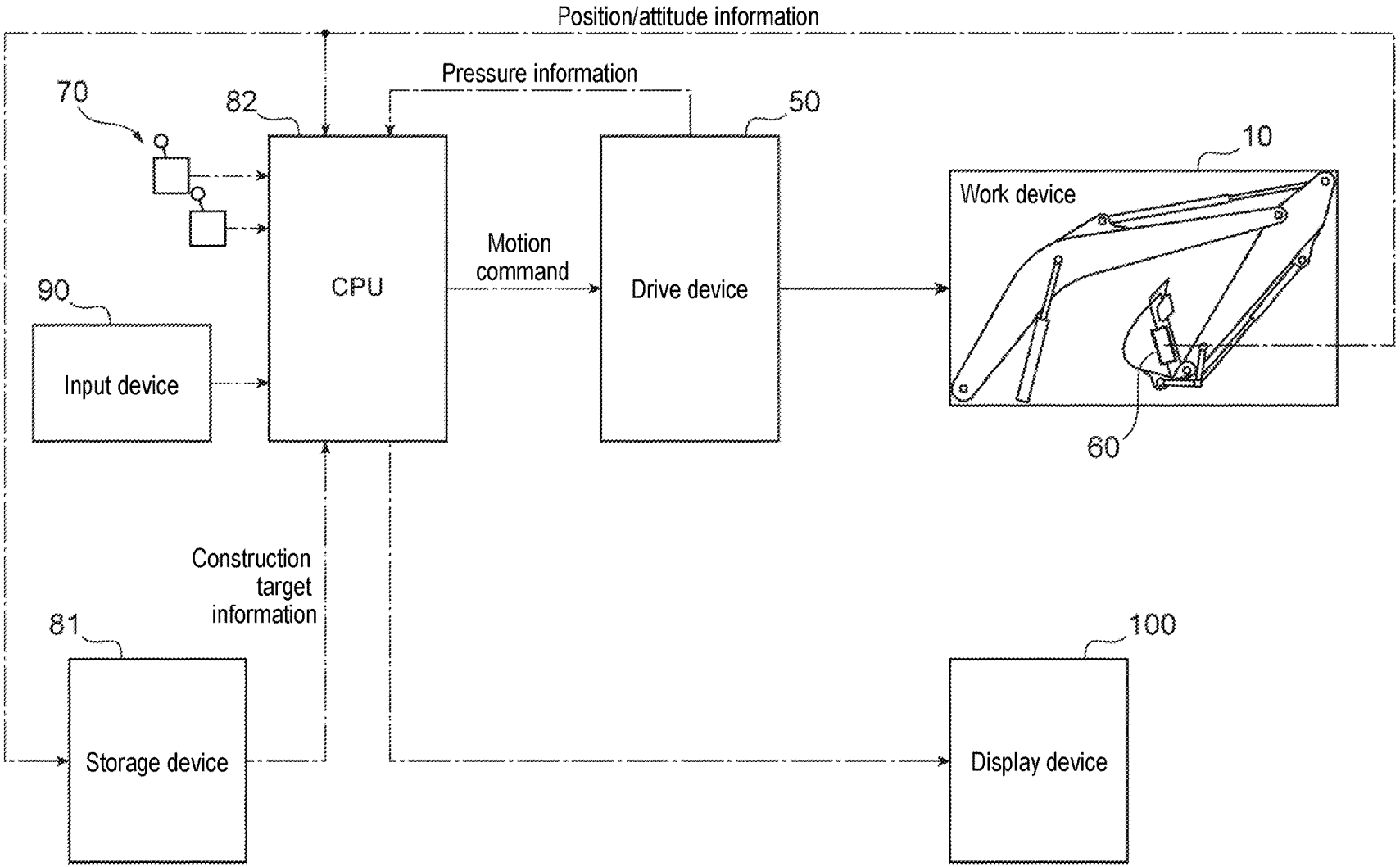
FIG. 2 is a functional block diagram of the work machine illustrated in FIG. 1.

FIG. 1 is a schematic diagram illustrating Embodiment 1 of the work machine of the present disclosure. FIG. 2 is a functional block diagram of the work machine 1 illustrated in FIG. 1. The work machine 1 of the present embodiment is, for example, a hydraulic shovel provided with a system for assisting informational construction. Informational construction involves utilizing information and communication technology during construction at the site of resources mining or building operation, for example, to exchange electronic information obtained from each process and to realize highly efficient and highly accurate construction. While the details will be described later, the work machine 1 of the present embodiment has the following major configuration features.

The work machine 1 is provided with a work device 10 for performing work, a rotating structure 20 to which the work device 10 is mounted, a rotating device 30 for rotating the rotating structure 20, and a travelling device 40 for supporting and travelling the rotating structure 20 via the rotating device 30. The work machine 1 is also provided with: a drive device 50 for driving the work device 10, the rotating device 30, and the travelling device 40; a sensor 60 as a position/attitude detection device for detecting the position and attitude of the work device 10; an operating device 70 for directing the operation of the work device 10, the rotating device 30, and the travelling device 40; and an operation amount detection device for detecting the amount of operation of the operating device 70. Further, the work machine 1 is provided with a control device 80 for controlling the drive device 50 based on the amount of operation of the operating device 70 and the position and attitude of the work device 10.

The control device 80 includes a storage device 81 and a central processing device 82. The storage device 81 has stored therein construction target information for the work device 10, and determination criteria information for the work content of the work device 10 based on the amount of operation of the rotating device 30. The central processing device 82 determines the work content of the work device 10 based on the position and attitude of the work device 10 detected by the sensor 60, the amount of operation of the rotating device 30 detected by the operation amount detection device for detecting the amount of operation of the operating device 70, and the determination criteria information stored in the storage device 81. Also, the central processing device 82 calculates a correction value for the construction target information based on the determined work content, and controls the drive device 50 based on the construction target information and the correction value to assist an operation by an operator.

In the following, the configuration of various parts of the work machine 1 of the present embodiment will be described in detail. The work device 10 is a device that the work machine 1 uses to perform work, such as excavating work or leveling work. The work device 10 is provided with, for example, a boom 11, an arm 12, and a bucket 13.

A proximal-end portion of the boom 11 is coupled to the rotating structure 20 via, for example, a pivot shaft which, not illustrated, is parallel to the width direction of the work machine 1. The boom 11, for example, is driven by a boom cylinder 51 constituting the drive device 50, and pivots up and down within a predetermined angle range about the pivot shaft, which, not illustrated, is mounted to the rotating structure 20.

A proximal-end portion of the arm 12 is coupled to a distal-end portion of the boom 11 via, for example, a pivot shaft 12*a* parallel to the width direction of the work machine 1. The arm 12 is driven by, for example, an arm cylinder 52 constituting the drive device 50, and pivots within a predetermined angle range about the pivot shaft 12*a*, which is mounted to the boom 11.

A proximal-end portion of the bucket 13 is coupled to a distal-end portion of the arm 12 via, for example, a pivot shaft 13*a* parallel to the width direction of the work machine 1, and a link mechanism 131. The bucket 13 is driven by, for example, a bucket cylinder 53 constituting the drive device 50, and pivots within a predetermined angle range about the pivot shaft 13*a*, which is mounted to the arm 12.

The rotating structure 20 has a front portion to which the work device 10 is mounted, and a rear portion fitted with a counter weight 21. The front portion of the rotating structure 20 includes a cab 22 adjacent to the work device 10 in the width direction of the rotating structure 20. The rotating structure 20 is connected to the travelling device 40 via the rotating device 30, and is supported over the travelling device 40 via the rotating device 30. Thus, the rotating structure 20 is provided to be rotatable relative to the travelling device 40 about a rotational axis parallel to the up-down direction of the work machine 1. The rotating structure 20 houses, for example: a prime mover not illustrated; a hydraulic device and a rotating motor 54 constituting the drive device 50; the operating device 70; the operation amount detection device; the control device 80; and an input device 90 and a display device 100 illustrated in FIG. 2.

The rotating device 30 is mounted over the travelling device 40 and is driven by the drive device 50 to cause the rotating structure 20 to rotate relative to the travelling device 40. More specifically, the rotating device 30 is driven by the rotating motor 54 constituting the drive device 50, and causes the work device 10 and the rotating structure 20 to rotate relative to the travelling device 40 about the rotational axis parallel to the up-down direction of the work machine 1.

The travelling device 40 is provided with, for example, left and right crawlers 41 having tracks, and left and right travelling motors, not illustrated. The travelling device 40 drives each of the left and right crawlers 41 by the left and right travelling motors to cause the work machine 1 to travel. The left and right travelling motors are, for example, hydraulic motors constituting the drive device 50.

The drive device 50 includes, for example, the boom cylinder 51, the arm cylinder 52, the bucket cylinder 53, the rotating motor 54, and the travelling motors described above, and drives the work device 10, the rotating device 30, and the travelling device 40. The drive device 50 is a hydraulic device, for example, and is provided with a plurality of hydraulic pumps driven by the prime mover, and a plurality of direction control valves connected to the hydraulic pumps to switch the direction of hydraulic oil. Further, the drive device 50 is provided with a pressure sensor, for example, which, not illustrated, outputs pressure information about the hydraulic oil in the various units constituting the drive device 50 to the control device 80.

The sensor 60 detects the position and attitude of the work device 10. In the example illustrated in FIG. 1, the sensor 60 is attached to the bucket 13, which is a work implement of the work device 10, and detects the position and attitude of the bucket 13. Examples of the sensor 60 include satellite positioning systems, such as a Global Positioning System (GPS) and a Global Navigation Satellite System (GNSS).

It is noted that the sensor 60 may not be attached to the bucket 13 and is not particularly limited; any sensor capable of detecting the position and attitude of the work device 10 may be used. For example, the sensor 60 may be a position sensor capable of calculating the position and attitude of the work device 10 by detecting the strokes of the boom cylinder 51, the arm cylinder 52, and the bucket cylinder 53. Further, the sensor 60 may be an angle sensor capable of calculating the position and attitude of the work device 10 by detecting the rotational angles of the boom 11, the arm 12, and the bucket 13, for example.

The operating device 70 includes, for example, operating levers and operating pedals housed in the cab 22 of the rotating structure 20. The operation amount detection device detects the amount of operation of the operating device 70 including, for example, the amount of operation of the operating levers and the amount of operation of the operating pedals. The operating device 70 is operated by the operator. The operation amount detection device, based on the operation of the operating device 70 by the operator, detects the amounts of operation of the work device 10, the rotating device 30, and the travelling device 40.

The control device 80, based on the amount of operation of the operating device 70 detected by the operation amount detection device and the position and attitude of the work device 10 detected by the sensor 60, controls the drive device 50. The control device 80 includes the storage device 81 and the central processing device 82. Further, the control device 80 is provided with an input/output unit, for example, and is communicatively connected to the drive device 50, the sensor 60, the operating device 70, the operation amount detection device, the input device 90, the display device 100 and the like.

The storage device 81 may include a random-access memory (RAM), a read-only memory (ROM), and a hard disk drive (HDD), for example, and has stored therein various information, a computer program and the like. More specifically, the storage device 81 has stored therein construction target information for the work device 10, and determination criteria information for the work content of the work device 10 based on the amount of operation of the rotating device 30. The construction target information and the determination criteria information will be described later.

The central processing device 82 performs various processes by reading the various information and the computer program stored in the storage device 81, for example. Specifically, the central processing device 82, for example, outputs a motion command to the drive device 50 based on an operation signal corresponding to the amount of operation of the operating device 70 detected by the operation amount detection device, the construction target information stored in the storage device 81, and the position and attitude of the work device 10 detected by the sensor 60.

Further, the central processing device 82 determines the work content of the work device 10 based on the position and attitude of the work device 10 detected by the sensor 60, the amount of operation of the rotating device 30 detected by the operation amount detection device, and the determination criteria information stored in the storage device 81. Also, the central processing device 82 calculates a correction value for the construction target information based on the determined work content, and controls the drive device 50 based on the construction target information and the correction value to assist the operator's operation.

The input device 90 is provided in the cab 22 of the rotating structure 20, for example, and has a configuration enabling the input of information by the operator. Specifically, the input device 90 may include input devices such as a keyboard, buttons, and a touch panel, and outputs the information input by the operator to the control device 80.

The display device 100 is provided in the cab 22 of the rotating structure 20, for example, and is disposed in a position viewable by the operator. The display device 100 includes a liquid crystal display device or an organic EL display device, for example, and, under the control of the control device 80, displays images Ia, Ib based on the construction target information, the position and attitude of the work device 10, the work content of the work device 10, and the correction value, as will be described below (see FIG. 6A and FIG. 6B).

Figure 3:
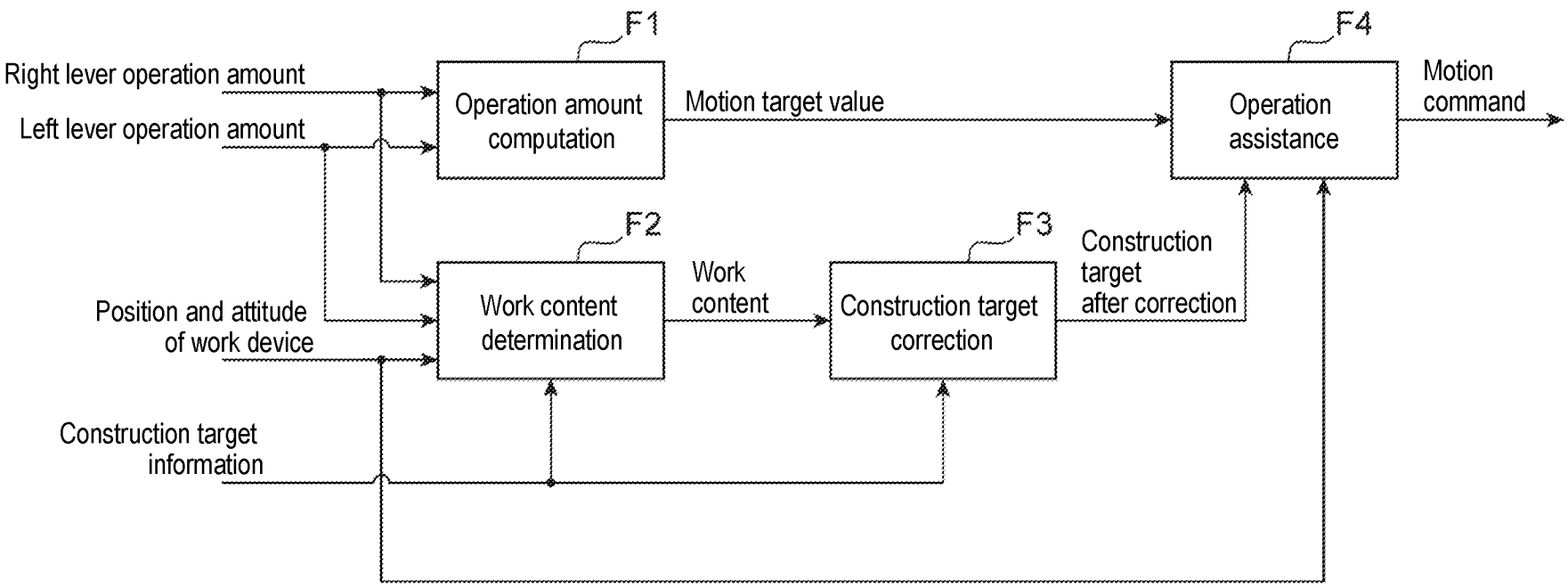
FIG. 3 is a functional block diagram of a control device for the work machine illustrated in FIG. 1.

FIG. 3 is a functional block diagram of the control device 80 of the work machine 1 illustrated in FIG. 1. The control device 80 is provided with, for example, an operation amount computing function F1, a work content determination function F2, a construction target correction function F3, and an operation assistance function F4. These functions may be implemented by the central processing device 82 using the information input to the control device 80, the information stored in the storage device 81, and the computer program, for example.

In the operation amount computing function F1, the central processing device 82 computes the amounts of operation of the work device 10, the rotating device 30, and the travelling device 40 based on the amount of operation of the operating device 70 by the operator detected by the operation amount detection device, for example. The amount of operation of the operating device 70 by the operator detected by the operation amount detection device includes the amount of operation of a right lever and the amount of operation of a left lever, for example. The amounts of operation of the work device 10, the rotating device 30, and the travelling device 40 calculated in the operation amount computing function F1 are target values of the motion of the drive device 50, such as a speed demanded by the operator, for example. That is, in the operation amount computing function F1, the central processing device 82 calculates motion target values for the drive device 50 based on the amount of operation of the operating device 70 detected by the operation amount detection device.

Figure 4:
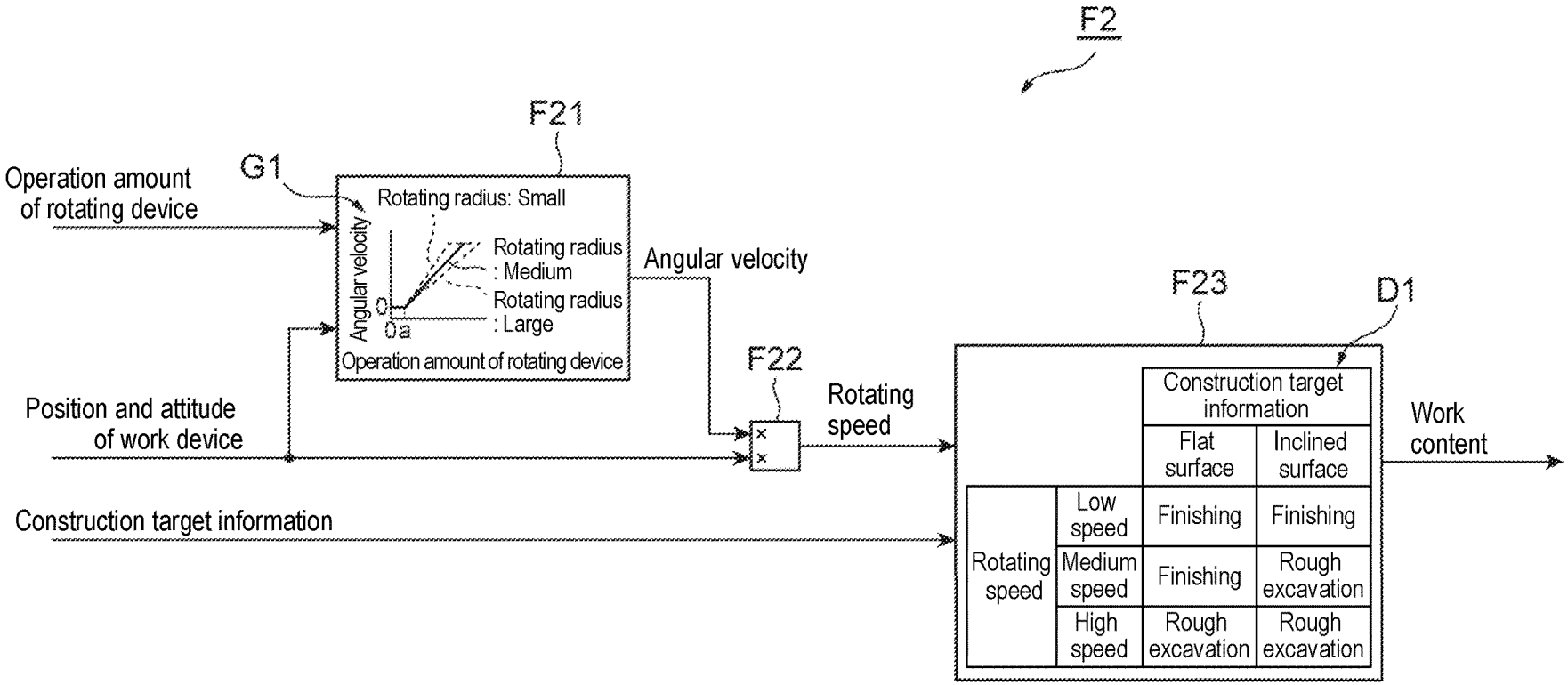
FIG. 4 is a functional block diagram illustrating the details of a work content determination function of FIG. 3.

FIG. 4 illustrates an example of a functional block diagram illustrating the details of the work content determination function F2 of FIG. 3. In the work content determination function F2, the central processing device 82 determines the work content of the work device 10 based on the position and attitude of the work device 10 detected by the sensor 60, the amount of operation of the rotating device 30 detected by the operation amount detection device, and the determination criteria information D1 stored in the storage device 81. More specifically, the work content determination function F2 includes, for example, an angular velocity computing function F21, a rotating speed computing function F22, and a rotating work determination function F23.

In the angular velocity computing function F21, the central processing device 82 predicts or calculates the angular velocity of the work device 10 based on a graph G1 stored in the storage device 81, for example. More specifically, the central processing device 82 predicts or calculates, based on the graph G1, the angular velocity of the bucket 13 of the work device 10 when the rotating device 30 rotates the rotating structure 20 and the work device 10 relative to the travelling device 40. The graph G1 indicates, for example, the relationship between the amount of operation of the rotating device 30 detected by the operation amount detection device and the angular velocity of the bucket 13 rotated by the rotating device 30.

In the example illustrated in FIG. 4, the graph G1 indicates that the work device 10 does not rotate and the angular velocity of the work device 10 is zero until the amount of operation of the rotating device 30 detected by the operation amount detection device exceeds a predetermined value a. This is to accommodate, for example, any play in the operating levers or operating pedals of the operating device 70, i.e., a region (dead zone) in which the rotating device 30 is not driven by the drive device 50 when the operating levers or the operating pedals are operated.

Also, in the example illustrated in FIG. 4, the graph G1 indicates that, when the amount of operation of the rotating device 30 is over the predetermined value a, the relationship between the amount of operation of the rotating device 30 and the angular velocity of the work device 10 rotated by the rotating device 30 is proportional. Further, in the example illustrated in FIG. 4, the graph G1 indicates that, in accordance with the rotating radius of the work device 10, the slope of the straight line representing the relationship between the amount of operation of the rotating device 30 and the angular velocity of the work device 10 varies.

That is, in the angular velocity computing function F21, the central processing device 82 predicts or calculates the rotating radius of the work device 10, such as the rotating radius of the teeth of the bucket 13, based on the position and attitude of the work device 10 detected by the sensor 60, for example. Here, suppose, for example, that the rotating radius calculated by the central processing device 82 is less than a first threshold value. In this case, the central processing device 82 predicts or calculates the angular velocity of the work device 10 based on a straight line with the greatest slope in the graph G1 and the amount of operation of the rotating device 30, for example.

Further, in the angular velocity computing function F21, suppose, for example, that the rotating radius calculated by the central processing device 82 is greater than or equal to a second threshold value greater than the first threshold value. In this case, the central processing device 82 predicts or calculates the angular velocity of the work device 10 based on a straight line with the smallest slope of the graph G1 and the amount of operation of the rotating device 30, for example.

Further, in the angular velocity computing function F21, suppose, for example, that the rotating radius calculated by the central processing device 82 is greater than or equal to the first threshold value and smaller than the second threshold value. In this case, the central processing device 82 predicts or calculates the angular velocity of the work device 10 based on a straight line with a medium slope between the straight line with the smallest slope and the straight line with the greatest slope of the graph G1, and the amount of operation of the rotating device 30.

That is, in the example of the angular velocity computing function F21 illustrated in FIG. 4, the angular velocity of the work device 10 predicted or calculated by the central processing device 82 increases as the amount of operation of the rotating device 30 increases, and increases as the rotating radius of the work device 10 decreases.

In the rotating speed computing function F22, the storage device 81, for example, calculates the rotating radius of the work device 10 based on the position and attitude of the work device 10 detected by the sensor 60. Further, in the rotating speed computing function F22, the storage device 81 predicts or calculates the rotating speed of the work device 10 by, for example, multiplying the calculated rotating radius of the work device 10 by the angular velocity of the work device 10 predicted or calculated in the angular velocity computing function F21.

In the rotating work determination function F23, the storage device 81, for example, determines the work content of the work device 10 based on the rotating speed of the work device 10 predicted or calculated in the rotating speed computing function F22, and the construction target information stored in the storage device 81. In the example illustrated in FIG. 4, the storage device 81 determines the work content of the work device 10 based on the determination criteria information D1 stored in the storage device 81. Here, the central processing device 82, for example, determines the work content of the work device 10 based on the rotating speed of the work device 10 and the inclination angle of the construction target included in the construction target information.

In the example illustrated in FIG. 4, the determination criteria information D1 is in the form of a table defining the work content of the work device 10 in accordance with the rotating speed of the work device 10 and the construction target information. More specifically, the storage device 81 has stored therein, for example, a speed threshold value for classifying the rotating speed of the work device 10 as being low speed, medium speed, or high speed, and an angle threshold value for determining whether the object for construction included in the construction target information is a flat surface or an inclined surface. The central processing device 82, based on such threshold values, classifies the rotating speed of the work device 10 as being "low speed", "medium speed", or "high speed", and also determines whether the object for construction included in the construction target information is a "flat surface" or an "inclined surface".

Specifically, based on the determination criteria information D1, the central processing device 82, for example, determines that the work content of the work device 10 is "finishing" if the rotating speed of the work device 10 is "low speed", both when the object for construction included in the construction target information is "flat surface" and when the object is "inclined surface". Further, the central processing device 82, for example, determines that the work content of the work device 10 is "finishing" if the rotating speed of the work device 10 is "medium speed" and the object for construction included in the construction target information is "flat surface". Further, the central processing device 82, for example, determines that the work content of the work device 10 is "rough excavation" if the rotating speed of the work device 10 is "medium speed" and the object for construction included in the construction target information is "inclined surface". Further, the central processing device 82, for example, determines that the work content of the work device 10 is "rough excavation" if the rotating speed of the work device 10 is "high speed" both when the object for construction included in the construction target information is "flat surface" and when the object is "inclined surface".

Figure 5:
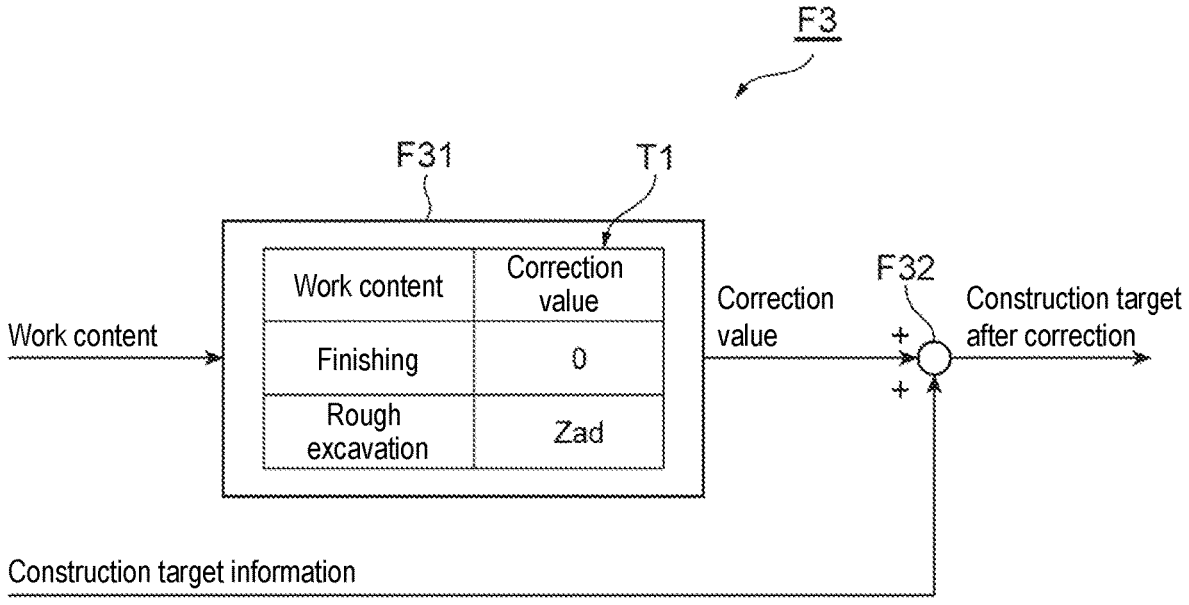
FIG. 5 is a functional block diagram illustrating the details of a construction target correction function of FIG. 3.

FIG. 5 is an example of a functional block diagram illustrating the details of the construction target correction function F3 of FIG. 3. As illustrated in FIG. 3, in the construction target correction function F3, the central processing device 82 calculates a correction value for the construction target information based on the work content of the work device 10 determined in the work content determination function F2. As illustrated in FIG. 5, the construction target correction function F3 includes, for example, a correction value calculating function F31 and a construction target correction function F32.

In the correction value calculating function F31, the central processing device 82 calculates the correction value based on the work content of the work device 10 determined in the work content determination function F2, for example. In the example illustrated in FIG. 5, the storage device 81 has stored therein a table T1 defining correction values corresponding to the work content of the work device 10, for example. The central processing device 82 calculates the correction value based on the work content of the work device 10 determined in the work content determination function F2 and the table T1, for example.

Specifically, in the correction value calculating function F31, the central processing device 82, for example, if the work content of the work device 10 determined in the work content determination function F2 is "finishing", calculates or sets "0" as the correction value based on the table T1. Further, the central processing device 82, for example, if the work content of the work device 10 determined in the work content determination function F2 is "rough excavation", calculates or sets "Zad" as the correction value based on the table T1. The correction value Zad is an arbitrary value that is set in advance, and is the distance between the flat surface or inclined surface of the construction target and the teeth of the bucket 13, for example.

In the construction target correction function F32, the central processing device 82, for example, adds the correction value calculated or set in the correction value calculating function F31 and the construction target information stored in the storage device 81. More specifically, the central processing device 82, for example, adds the correction value to the height of the construction target included in the construction target information stored in the storage device 81, and outputs the construction target information after correction. Here, the correction value is the distance in the vertical direction, i.e., the height, between the flat surface or inclined surface as the construction target and the teeth of the bucket 13 as a part of the work device 10, for example.

As illustrated in FIG. 3, in the operation assistance function F4, the central processing device 82 controls the drive device 50 based on the construction target information and the correction value to assist the operator's operation. More specifically, the central processing device 82, for example, outputs a motion command for the drive device 50 based on the motion target value calculated in the operation amount computing function F1, the construction target information after correction calculated in the construction target correction function F3, and the position and attitude of the work device 10 detected by the sensor 60. In this way, the control device 80 performs semi-automatic control for assisting the operator's operation.

The position and attitude of the work device 10 detected by the sensor 60 includes, for example, position information about the teeth of the bucket 13. The central processing device 82 outputs the motion command for the drive device 50 based on the position information about the teeth of the bucket 13. Also, the motion target value calculated in the operation amount computing function F1 includes, for example, a target speed of the teeth of the bucket 13 intended by the operator. The central processing device 82 outputs the motion command for the drive device 50 based on the target speed of the teeth of the bucket 13.

Figure 6A:
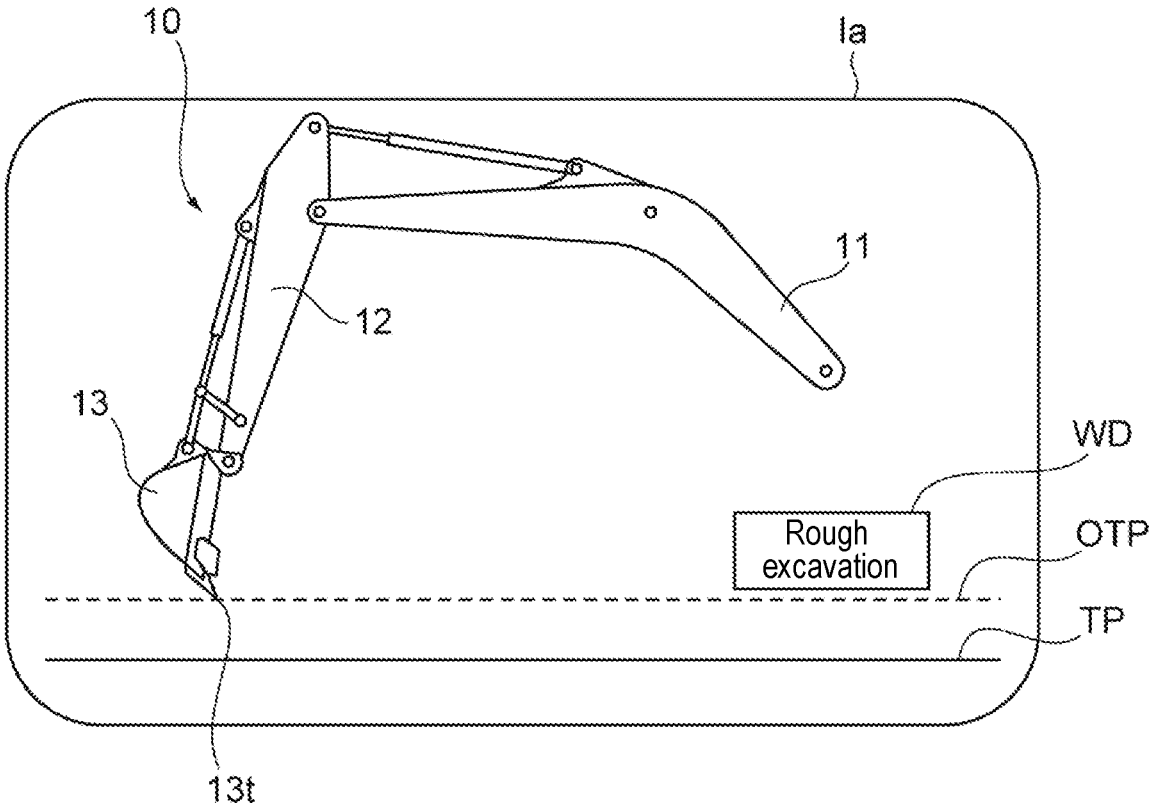
FIG. 6A is an image diagram illustrating an example of an image displayed on a display device of FIG. 2.
Figure 6B:
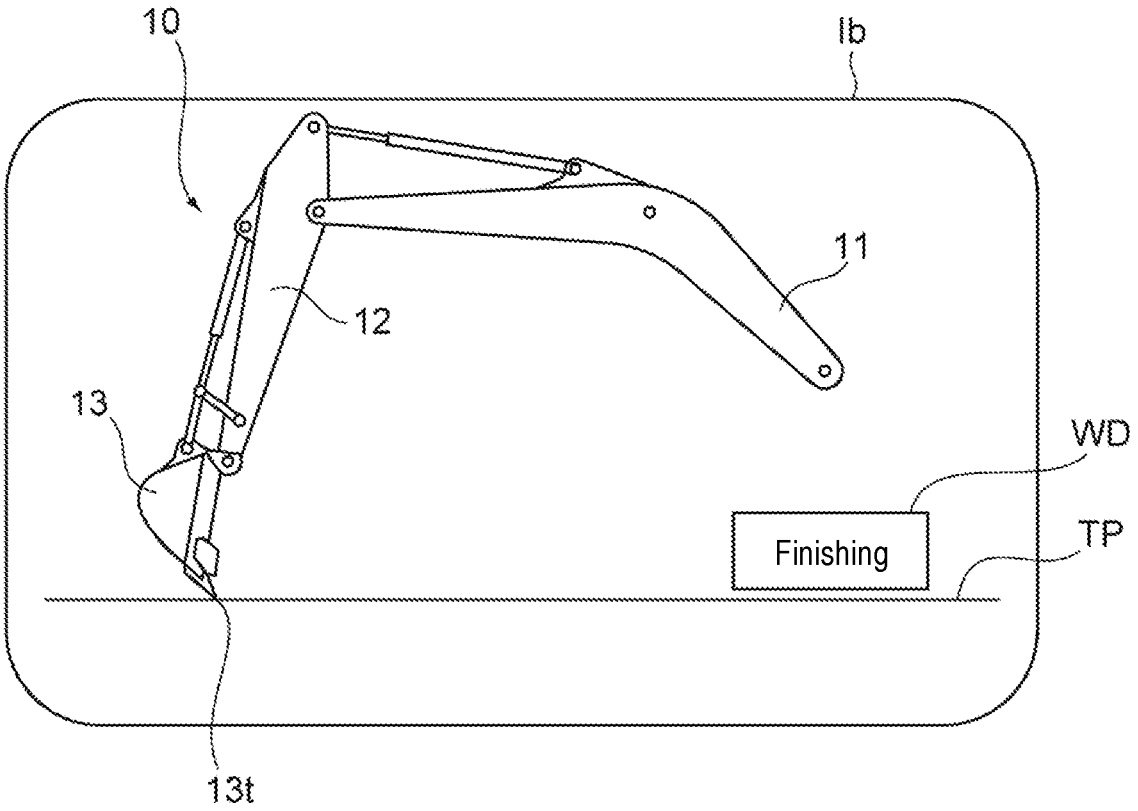
FIG. 6B is an image diagram illustrating an example of an image displayed on the display device of FIG. 2.

FIG. 6A and FIG. 6B are image diagrams illustrating examples of images Ia, Ib displayed on the display device 100. In each of the images Ia, Ib, the position and attitude of the work device 10 including a position 13*t* of the teeth of the bucket 13, construction target TP, and work content WD are displayed. Further, in the image Ia illustrated in FIG. 6A, a post-correction construction target OTP is displayed.

The display device 100, for example, displays the position and attitude of the work device 10 output from the central processing device 82 in the images Ia, Ib. Further, the display device 100, based on the construction target information output from the central processing device 82, displays the position and shape of the construction target TP in the images Ia, Ib. Further, the display device 100 displays the work content WD in the images Ia, Ib based on the work content of the work device 10 output from the central processing device 82.

Further, the display device 100 displays the position and shape of the post-correction construction target OTP in the image Ia illustrated in FIG. 6A, based on the construction target information after correction output from the central processing device 82. The display device 100 may cause the construction target TP and the post-correction construction target OTP to be displayed by different display methods. Specifically, for example, the construction target TP may be displayed by a solid line, and the post-correction construction target OTP may be displayed by a dashed line.

In the following, the action of the work machine 1 of the present embodiment will be described.

The operator sitting in the cab 22 of the work machine 1 inputs necessary information to the input device 90 located in the cab 22 to cause construction target information to be stored in the storage device 81, for example. A plurality of items of construction target information may be stored in the storage device 81 in advance, and necessary information may be input to the input device 90 to select arbitrary construction target information stored in the storage device 81. In addition, the construction target information may be stored in the storage device 81 by means of information communication, such as wireless communication and wired communication. The construction target information includes, for example, the three-dimensional shape of and position information about the object for construction, such as a ground surface.

The operator, for example, operates the operating levers and operating pedals of the operating device 70 in the cab 22, and determines, by the direction and amount of the operation, the directions of motion and speeds of motion of the work device 10, the rotating device 30, and the travelling device 40 of the work machine 1. The operation amount detection device detects the amount of operation based on the operation of the operator operating device 70, and outputs the amount of operation to the control device 80. The control device 80, based on the input amount of operation, calculates a motion command using the central processing device 82, and outputs the motion command to the drive device 50.

The drive device 50 drives the work device 10 by extending and contracting the boom cylinder 51, the arm cylinder 52, and the bucket cylinder 53 in accordance with the input motion command. Further, the drive device 50 rotates the rotating motor 54 in accordance with the input motion command, thereby driving the rotating device 30 and rotating the work device 10 and the rotating structure 20. Further, the drive device 50 causes the travelling motors to turn in accordance with the input motion command, thereby driving the travelling device 40 and causing the work machine 1 to travel.

For example, when the work content of the work device 10 is "rough excavation" for shaping the object for construction closer to the construction target shape, the operator tends to cause the rotating structure 20 and the work device 10 to rotate at relatively high speed. On the other hand, when the work content of the work device 10 is "finishing" for finishing the object for construction to the construction target shape, the operator tends to cause the rotating structure 20 and the work device 10 to rotate at relatively low speed.

Further, when the construction target shape is a flat surface or an inclined surface smaller than a predetermined inclination angle, the operator tends to cause the rotating structure 20 and the work device 10 to rotate at relatively high speed. On the other hand, when the construction target shape is an inclined surface greater than or equal to the predetermined inclination angle, the operator tends to cause the rotating structure 20 and the work device 10 to rotate at relatively low speed. This is because when the inclination angle of the surface of the construction target is greater than or equal to the predetermined inclination angle, more advanced operating techniques are required compared to when the inclination angle of the surface of the construction target is smaller than the predetermined inclination angle.

However, in the conventional work machine control device, as noted above, construction involving a rotating motion is not taken into consideration. Thus, during construction involving a rotating motion, the offset topography and the target construction topography may be switched against the operator's intent. In contrast, the work machine 1 of the present embodiment is provided with the following configuration, as described above.

The work machine 1 is provided with: the work device 10 for performing work; the rotating structure 20 to which the work device 10 is mounted; the rotating device 30 for rotating the rotating structure 20; the travelling device 40 for supporting and travelling the rotating structure 20 via the rotating device 30; the drive device 50 for driving the work device 10, the rotating device 30, and the travelling device 40; the sensor 60 as a position/attitude detection device for detecting the position and attitude of the work device 10; the operating device 70 for directing the operation of the work device 10, the rotating device 30, and the travelling device 40; the operation amount detection device for detecting the amount of operation of the operating device 70; and the control device 80 for controlling the drive device 50 based on the amount of operation of the operating device 70 and the position and attitude of the work device 10. The control device 80 includes the storage device 81 and the central processing device 82. The storage device 81 has stored therein the construction target information for the work device 10 and the determination criteria information for the work content of the work device 10 based on the amount of operation of the rotating device 30. The central processing device 82 determines the work content of the work device 10 based on the position and attitude of the work device 10 detected by the sensor 60, the amount of operation of the rotating device 30 detected by the operation amount detection device, and the determination criteria information stored in the storage device 81. Further, the central processing device 82 calculates a correction value for the construction target information based on the determined work content, and controls the drive device 50 based on the construction target information and the correction value to assist the operator's operation.

With this configuration, the work machine 1 of the present embodiment can determine, using the control device 80, the work content of the work device 10 based on the amount of operation of the rotating device 30 corresponding to the operation of the operating device 70 by the operator. Specifically, for example, it is possible to determine, using the central processing device 82, whether the work content of the work device 10 is "finishing" or "rough excavation" based on the rotating speed of the work device 10 corresponding to the amount of operation of the rotating device 30 and the determination criteria information D1 stored in the storage device 81, as described above.

Further, it is possible, using the central processing device 82, to calculate a correction value for the construction target information based on the determined work content, and to then control the drive device 50 based on the construction target information and the correction value to assist the operator's operation. Specifically, if the work content of the work device 10 is "finishing", for example, the central processing device 82 adds "0" as the correction value to the construction target information as described above, and then outputs a motion command to drive the drive device 50 so that the shape of the object for construction becomes the construction target shape. In this way, the work machine 1 of the present embodiment can provide operation assistance for "finishing" that is the work content matching the operator's intent in consideration of a rotating motion of the work device 10.

Further, if the work content of the work device 10 is "rough excavation", the central processing device 82, for example, can add the predetermined correction value Zad to the construction target information, and then output a motion command to drive the drive device 50 so that the shape of the object for construction becomes the construction target shape after correction, as described above. In this way, the control device 80 can, based on the relationship between the operator's operation including rotation of the work device 10, the construction target information, and the position and attitude of the work device 10, perform semi-automatic control of the work machine 1 so that the construction target is offset upward by a predetermined height to prevent excessive excavation of the object for construction. In this way, the work machine 1 of the present embodiment can provide operation assistance for "rough excavation" that is the work content matching the operator's intent in consideration of a rotating motion of the work device 10.

Further, in the work machine 1 of the present embodiment, the central processing device 82 calculates the rotating radius of the work device 10 based on the position and attitude of the work device 10, and calculates the angular velocity of the work device 10 based on the rotating radius. Further, the central processing device 82 calculates the rotating speed of the work device 10 based on the calculated rotating radius and angular velocity, and determines the work content of the work device 10 based on the rotating speed and the inclination angle of the construction target included in the construction target information stored in the central processing device 82.

With this configuration, the work machine 1, as described above, can determine the work content of the work device 10 in consideration of not only the amount of operation of the rotating device 30 based on the operator's operation, but also the inclination of the construction target and the attitude of the work device 10. Accordingly, with the work machine 1 of the present embodiment, it is possible to determine the work content better matching the operator's intent, and to provide operation assistance better matching the operator's intent.

Further, the work machine 1 of the present embodiment, as described above, is provided with the display device 100 for displaying the images Ia, Ib based on the construction target information, the position and attitude of the work device 10, the work content of the work device 10, and the correction value for the construction target information.

With this configuration, it is possible to allow the operator of the work machine 1 to visually recognize the status of the work machine 1. That is, the operator, by viewing the display device 100, can confirm the work content of the work device 10 determined by the work machine 1. In this way, the operator can confirm whether the operation assistance provided by the control device 80 of the work machine 1 matches his or her intension.

As described above, according to the present embodiment, it is possible to provide the work machine 1 capable of providing operation assistance matching the operator's intent in consideration of a rotating motion.

Embodiment 2

Next, with reference to FIG. 7 and also to FIG. 1 to FIG. 3, FIG. 5, and FIG. 6 in support thereof, Embodiment 2 of the work machine according to the present disclosure will be described.

Figure 7:
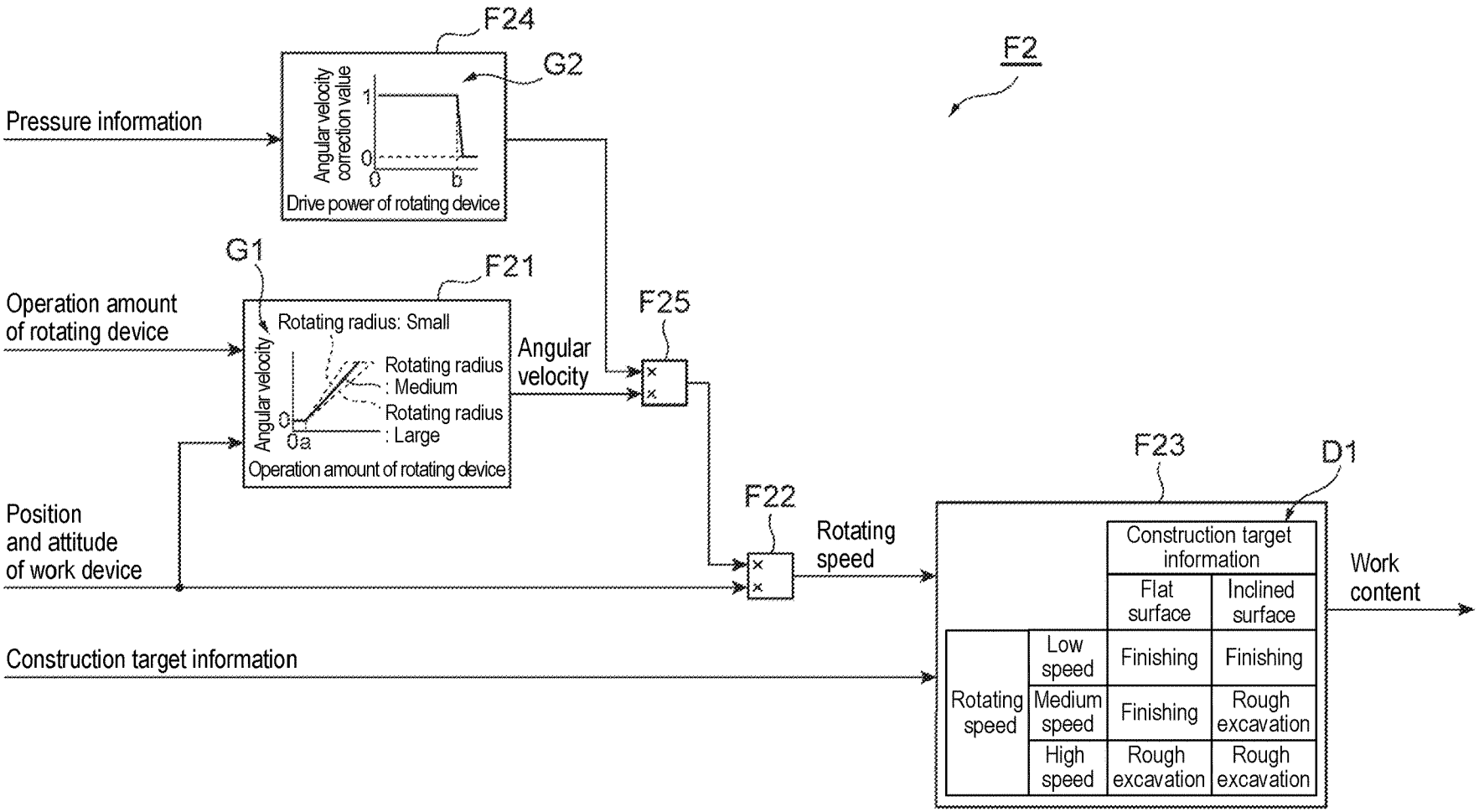
FIG. 7 is a functional block diagram of a work content determination function according to Embodiment 2 of the work machine of the present disclosure.

FIG. 7 is a functional block diagram illustrating the details of the work content determination function F2 of the work machine 1 of Embodiment 2. The work machine 1 of the present embodiment differs from the work machine 1 of Embodiment 1 described above in that a rotation limitation determination function F24 and an angular velocity correction function F25 illustrated in FIG. 7 are included in the work content determination function F2 of the control device 80 illustrated in FIG. 3. The work machine 1 of the present embodiment is similar to the work machine 1 of Embodiment 1 in other respects. Accordingly, similar portions are designated with similar reference signs and their description is omitted.

In the rotation limitation determination function F24, the central processing device 82, for example, calculates the drive power of the rotating device 30 based on pressure information output from a pressure sensor for detecting the pressure of hydraulic oil of the drive device 50 as a hydraulic device. The storage device 81, for example, has stored therein a threshold value "b" for the drive power of the rotating device 30. In the example illustrated in FIG. 7, the storage device 81, for example, has stored therein a graph G2 indicating the relationship between the drive power of the rotating device 30 and angular velocity correction value. The graph G2 indicates that, for example, the angular velocity correction value is "1" until the drive power of the rotating device 30 exceeds the threshold value "b", and that the angular velocity correction value sharply decreases to "0" beyond the threshold value "b".

That is, in the rotation limitation determination function F24, the central processing device 82, for example, with reference to the graph G2 stored in the storage device 81, compares the drive power of the rotating device 30 based on the pressure information output from the pressure sensor of the drive device 50, and the threshold value "b" for the drive power of the rotating device 30. Further, the central processing device 82, based on the comparison, determines that there is no limitation to the rotating motion of the rotating structure 20 by the rotating device 30 if the drive power of the rotating device 30 based on the pressure information is less than or equal to threshold value "b", and outputs "1" as the angular velocity correction value. On the other hand, if the drive power of the rotating device 30 is greater than the threshold value "b", the central processing device 82, based on the graph G2, determines that there is limitation to the rotating motion of the rotating structure 20 by the rotating device 30, and outputs, as the angular velocity correction value, a value smaller than "1", or "0".

Then, in the angular velocity correction function F25, the central processing device 82 corrects the angular velocity by multiplying the angular velocity of the work device 10 calculated in the angular velocity computing function F21 by the angular velocity correction value determined in the rotation limitation determination function F24 based on the presence or absence of rotating motion limitation. Thus, if the drive power of the rotating device 30 is less than or equal to the threshold value "b", the angular velocity of the work device 10 calculated in the angular velocity computing function F21 becomes the input to the rotating speed computing function F22 as is. On the other hand, if the drive power of the rotating device 30 is greater than the threshold value "b", the angular velocity of the work device 10 calculated in the angular velocity computing function F21 is corrected to become smaller or zero.

As described above, in the work machine 1 of the present embodiment, the storage device 81 has stored therein the threshold value "b" for the drive power of the rotating device 30 due to the drive device 50. Further, the central processing device 82, based on a comparison of the drive power information about the rotating device 30 output from the drive device 50 and the threshold value "b" for the drive power of the rotating device 30, determines the presence or absence of limitation of the rotating motion of the rotating structure 20 by the rotating device 30. Then, the central processing device 82, upon determining that there is limitation of the rotating motion of the rotating structure 20, corrects the angular velocity calculated in the angular velocity computing function F21.

With this configuration, when the work device 10 of the work machine 1 is in contact with an obstacle and rotation of the work device 10 is hindered, for example, it is possible to prevent the pressure of hydraulic oil for the drive device 50 as a hydraulic device from exceeding an upper limit, thus improving the reliability of the work machine 1. Accordingly, with the work machine 1 of the present embodiment, it is possible to not only provide operation assistance matching the operator's intent in consideration of a rotating motion, as in the case of the work machine 1 of Embodiment 1 described above, but also to improve the reliability of the work machine 1.

Embodiment 3

Next, Embodiment 3 of the work machine according to the present disclosure will be described with reference to FIG. 8 and also to FIG. 1 to FIG. 3, FIG. 5, and FIG. 6 in support thereof.

Figure 8:
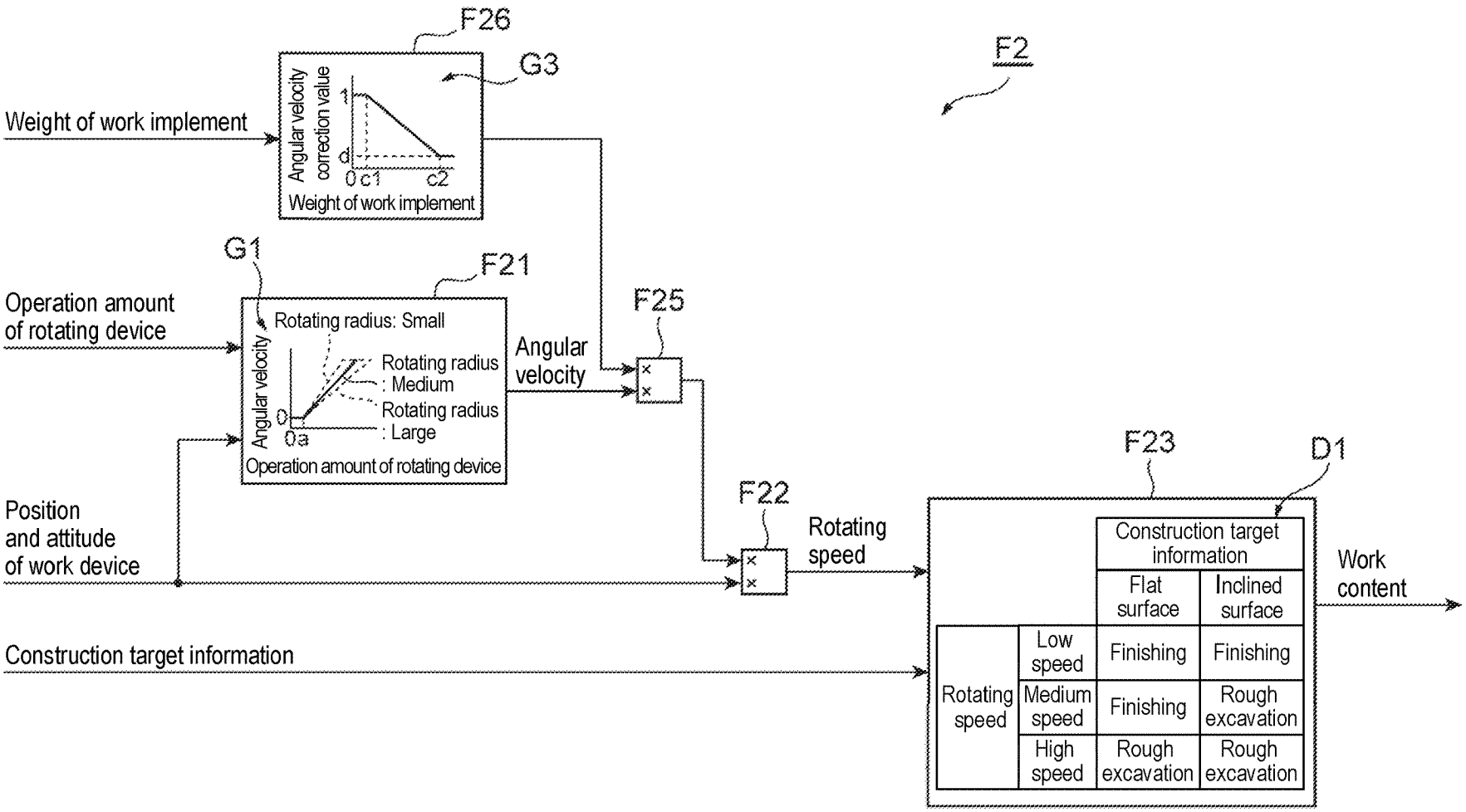
FIG. 8 is a functional block diagram of the work content determination function according to Embodiment 3 of the work machine of the present disclosure.

FIG. 8 is a functional block diagram illustrating the details of the work content determination function F2 in the work machine 1 of Embodiment 3. The work machine 1 of the present embodiment differs from the work machine 1 of Embodiment 1 described above in that an angular velocity correction function F25 and an angular velocity correction value calculating function F26 illustrated in FIG. 8 are included in the work content determination function F2 of the control device 80 illustrated in FIG. 3. The work machine 1 of the present embodiment is similar to the work machine 1 of Embodiment 1 in other respects. Thus, similar portions are designated with similar reference signs and their description is omitted.

In the work machine 1 of the present embodiment, the storage device 81, for example, has stored therein the weight of the work device 10 and an angular velocity correction value based on the weight of the work device 10. In the example illustrated in FIG. 8, the storage device 81 has stored therein a graph G3 indicating the relationship between the weight of the bucket 13 as a work implement at the distal end of the work device 10 and the angular velocity correction value. The graph G3 indicates that the angular velocity correction value is "1" when the weight of the work implement is less than or equal to a threshold value "c1". Further, the graph G3 indicates that the weight of the work implement and the angular velocity correction value are in an inversely proportional relationship when the weight of the work implement is greater than the threshold value "c1" and smaller than a threshold value "c2", and that the angular velocity correction value is smaller than "1" and greater than a predetermined value "d". Further, the graph G3 indicates that the angular velocity correction value is the predetermined value "d" when the weight of the work implement is greater than or equal to the threshold value "c2".

In the angular velocity correction value calculating function F26, the central processing device 82 calculates the angular velocity correction value based on the weight of the work device 10 stored in the storage device 81, such as the weight of the bucket 13 as a work implement of the work device 10, and the graph G3 stored in the storage device 81. Further, in the angular velocity correction function F25, the central processing device 82 multiplies the angular velocity of the work device 10 calculated in the angular velocity computing function F21 by the angular velocity correction value calculated in the angular velocity correction value calculating function F26, thus correcting the angular velocity.

Thus, if the weight of the work device 10, such as the weight of the bucket 13 as a work implement, for example, is less than or equal to the threshold value "c1", the angular velocity of the work device 10 calculated in the angular velocity computing function F21 becomes the input to the rotating speed computing function F22 as is. Further, if the weight of the work device 10, such as the weight of the bucket 13 as a work implement, for example, is greater than the threshold value "c1" and smaller than the threshold value "c2", the angular velocity of the work device 10 calculated in the angular velocity computing function F21 decreases in inverse proportion to the weight of the work device 10. Further, if the weight of the work device 10, such as the weight of the bucket 13 as a work implement, for example, is greater than or equal to the threshold value "c2", the angular velocity of the work device 10 calculated in the angular velocity computing function F21 is multiplied by the minimum value "d" of the angular velocity correction value, which is smaller than "1" and greater than "0".

As described above, in the work machine 1 of the present embodiment, the storage device 81 has stored therein an angular velocity correction value based on the weight of the work device 10, and the central processing device 82 corrects the angular velocity calculated or estimated in the angular velocity computing function F21 based on the angular velocity correction value.

Thus, the characteristic of the work machine 1 that the rotating speed is limited as the weight of the work device 10 increases can be reflected in the determination of the work content in the rotating work determination function F23. Accordingly, with the work machine 1 of the present embodiment, it is possible to provide not only operation assistance matching the operator's intent in consideration of a rotating motion, as in the case of the work machine 1 of Embodiment 1 described above, but also provide operation assistance reflecting the characteristic of the work machine 1.

Embodiment 4

Next, with reference to FIG. 9 and also to FIG. 1 to FIG. 3, FIG. 5, and FIG. 6 in support thereof, Embodiment 4 of the work machine according to the present disclosure will be described.

Figure 9:
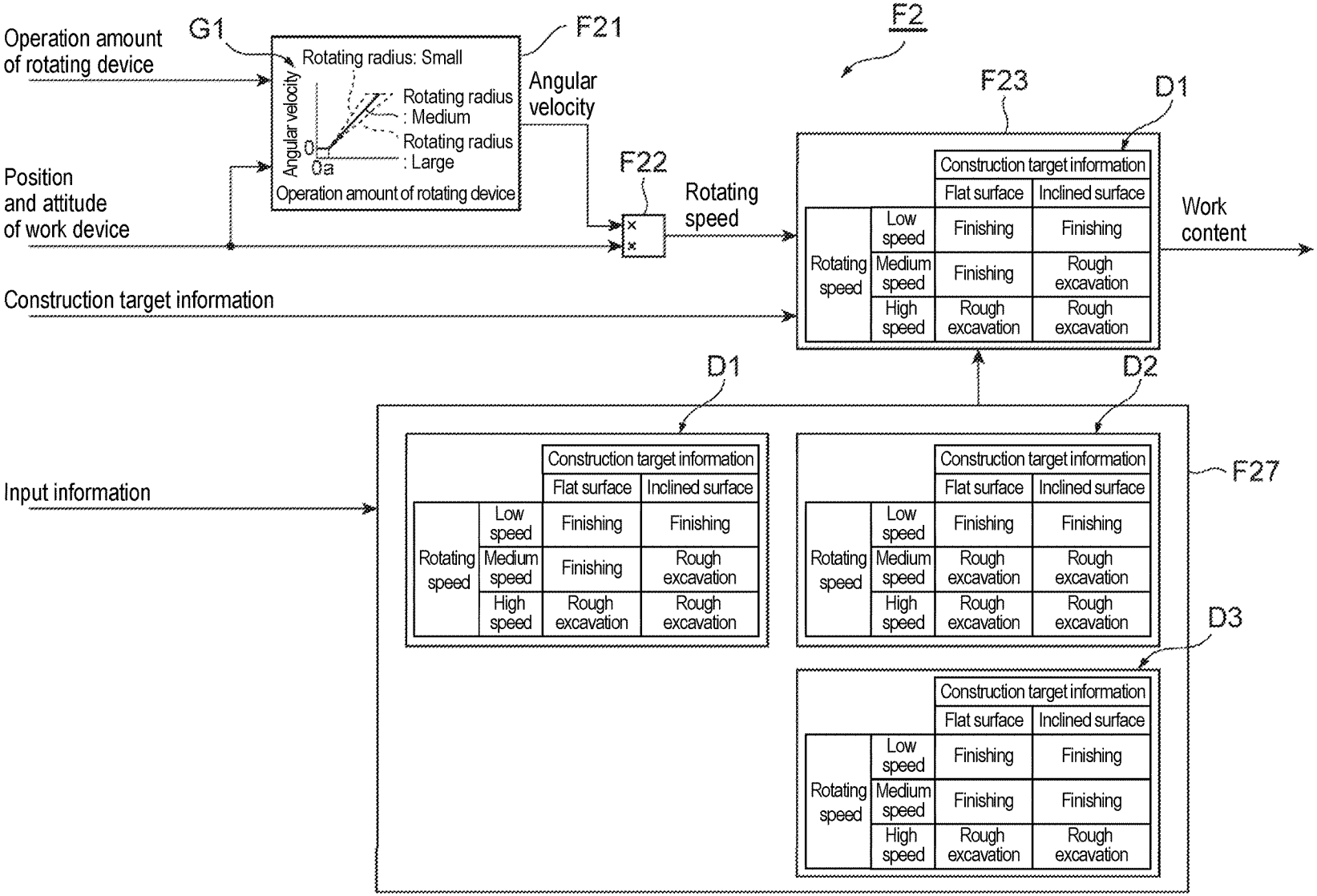
FIG. 9 is a functional block diagram of the work content determination function according to Embodiment 4 of the work machine of the present disclosure.

FIG. 9 is a functional block diagram illustrating the details of the work content determination function F2 in the work machine 1 of Embodiment 4. The work machine 1 of the present embodiment differs from the work machine 1 of Embodiment 1 described above in that a determination criterion modifying function F27 illustrated in FIG. 9 is included in the work content determination function F2 of the control device 80 illustrated in FIG. 3. The work machine 1 of the present embodiment is similar to the work machine 1 of Embodiment 1 described above in other respects. Thus, similar portions are designated with similar reference signs and their description is omitted.

The storage device 81 of the work machine 1 of the present embodiment, for example, has stored therein a plurality of different items of determination criteria information D1, D2, D3 that are selected in the determination criterion modifying function F27. The determination criteria information D1 is similar to that of Embodiment 1 described above. The determination criteria information D2 differs from the determination criteria information D1 in that, when the rotating speed of the work device 10 is "medium speed" and the shape of the object for construction included in the construction target information is "flat surface", the work content of the work device 10 is defined as "rough excavation". The determination criteria information D3 differs from the determination criteria information D1 in that, when the rotating speed of the work device 10 is "medium speed" and the shape of the object for construction included in the construction target information is "inclined surface", the work content of the work device 10 is defined as "finishing".

The input device 90, for example, is configured to enable the input of information for selecting one item of determination criteria information from the plurality of items of determination criteria information D1, D2, D3, the selecting information including, for example, a number or a sign corresponding to each item of determination criteria information. The central processing device 82, for example, based on the input information input to the input device 90, selects one item of determination criteria information from the plurality of items of determination criteria information D1, D2, D3, and uses the selected determination criteria information in the rotating work determination function F23.

As described above, the work machine 1 of the present embodiment is provided with the input device 90 enabling the input of information. Further, the storage device 81 has stored therein the plurality of different items of determination criteria information D1, D2, D3. The central processing device 82, based on the input information input to the input device 90, selects one item of determination criteria information from the plurality of items of determination criteria information D1, D2, D3, and determines the work content of the work device 10 based on the selected determination criteria information.

With this configuration, the operator can select one item of determination criteria information from the plurality of items of determination criteria information D1, D2, D3 in accordance with the operator's skills and preferences. Accordingly, with the work machine 1 of the present embodiment, it is possible to not only provide operation assistance matching the operator's intent in consideration of a rotating motion, as in the case of the work machine 1 of Embodiment 1, but also to provide operation assistance reflecting the operator's skills and preferences.

While the embodiments of the work machine according to the present disclosure have been described above with reference to the drawings, specific configurations are not limited to the embodiments, and any design changes and the like within the spirit and scope of the present disclosure are included in the present disclosure.

REFERENCE SIGNS LIST

1 Work machine
10 Work device
20 Rotating structure
30 Rotating device
40 Travelling device
50 Drive device
60 Sensor (position/attitude detection device)
70 Operating device
80 Control device
81 Storage device
82 Central processing device
90 Input device
100 Display device
D1 Determination criteria information
D2 Determination criteria information
D3 Determination criteria information

The invention claimed is:

1. A hydraulic shovel comprising:

a work device including a boom, an arm and a bucket, and for performing work including finishing and rough excavation of a construction target;

a rotating structure having the work device mounted thereto;

a rotating device for rotating the rotating structure;

a travelling device for supporting and travelling the rotating structure via the rotating device;

a drive device for driving the work device, the rotating device, and the travelling device;

a position/attitude detection device for detecting a position and an attitude of the bucket;

an operating device for directing an operation of the work device, the rotating device, and the travelling device;

an operation amount detection device for detecting an amount of operation of the operating device; and a control device for controlling the drive device based on the amount of operation and the position and the attitude of the bucket, wherein the control device includes a storage device and a central processing device, the storage device has stored therein construction target information for the work device, and determination criteria information for work content of the work device based on a rotating speed of the work device, and the central processing device calculates a rotating radius of the work device based on the position and the attitude of the bucket detected by the position/attitude detection device, calculates an angular velocity of the work device based on the amount of operation of the rotating device detected by the operation amount detection device and the rotating radius, calculates the rotating speed of the work device based on the rotating radius and the angular velocity, classifies the rotating speed into a plurality of speeds based on the rotating speed and a speed threshold value of the rotating speed, determines an object for construction based on an inclination angle of the construction target included in the construction target information and an angle threshold value of the inclination angle, determines whether the work content of the work device is the finishing or the rough excavation based on a result of classifying the rotating speed, a result of determining the object for construction, and the determination criteria information, calculates a correction value for the construction target information including a distance in a vertical direction between teeth of the bucket and the construction target based on the determined work content of the finishing or the rough excavation, and controls the drive device based on the construction target information and the correction value to perform semi-automatic control for assisting an operator's operation.

2. The hydraulic shovel according to claim 1, wherein the central processing device classifies the rotating speed into any one of a high speed, a medium speed, or a low speed based on the rotating speed and a speed threshold value of the rotating speed, determines whether the object for construction is a flat surface or an inclined surface based on an inclination angle of the construction target included in the construction target information and an angle threshold value of the inclination angle, based on the result of classifying the rotating speed, the result of determining the object for construction, and the determination criteria information, determines the work content to be the finishing when the result of classifying the rotating speed is the low speed and the result of determining the object for construction is the flat surface and the inclined surface, determines the work content to be the finishing when the result of classifying the rotating speed is the medium speed and the result of determining the object for construction is the flat surface, determines the work content to be the rough excavation when the result of classifying the rotating speed is the medium speed and the result of determining the object for construction is the inclined surface, and determines the work content to be the rough excavation when the result of classifying the rotating speed is the high speed and the result of determining the object for construction is the flat surface and the inclined surface.

3. The hydraulic shovel according to claim 1, wherein the storage device has stored therein a threshold value of drive power of the rotating device due to the drive device, and the central processing device, based on a comparison of drive power information about the rotating device output from the drive device and the threshold value, determines the presence or absence of limitation of a rotating motion of the rotating structure by the rotating device, and corrects the angular velocity upon determining that there is limitation of the rotating motion.

4. The hydraulic shovel according to claim 1, wherein the storage device has stored therein an angular velocity correction value based on a weight of the bucket, and the central processing device corrects the angular velocity based on the angular velocity correction value.

5. The hydraulic shovel according to claim 1, further comprising an input device enabling an input of information for selecting the determination criteria information, wherein the storage device has stored therein a plurality of different items of the determination criteria information, and the central processing device selects one item of the determination criteria information based on the input information input to the input device, and determines the work content based on the selected item of the determination criteria information.

6. The hydraulic shovel according to claim 1, further comprising a display device for displaying an image based on the construction target information, the position and the attitude of the work device, the work content of the bucket, and the correction value.

* * * * *